US008003045B2

(12) United States Patent
Muralidharan et al.

(10) Patent No.: US 8,003,045 B2
(45) **Date of Patent: *Aug. 23, 2011**

(54) CAST, HEAT-RESISTANT AUSTENITIC STAINLESS STEELS HAVING REDUCED ALLOYING ELEMENT CONTENT

(75) Inventors: Govindarajan Muralidharan, Knoxville, TN (US); Vinod Kumar Sikka, Oak Ridge, TN (US); Philip J. Maziasz, Oak Ridge, TN (US); Roman I. Pankiw, Greensburg, PA (US)

(73) Assignee: UT-Battelle, LLC, Oak Ridge, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/793,930

(22) Filed: Jun. 4, 2010

(65) Prior Publication Data

US 2010/0247370 A1 Sep. 30, 2010

Related U.S. Application Data

(63) Continuation of application No. 11/038,923, filed on Jan. 19, 2005, now Pat. No. 7,749,432.

(51) Int. Cl.
*C22C 38/44* (2006.01)
*C22C 38/48* (2006.01)

(52) U.S. Cl. ..... 420/53; 420/586.1; 148/327; 148/419

(58) Field of Classification Search ..... 148/327, 148/419; 420/53, 586.1
See application file for complete search history.

(56) References Cited

U.S. PATENT DOCUMENTS

| | | | |
|---|---|---|---|
| 3,627,516 | A | 12/1971 | Jean Bellot et al. |
| 3,758,294 | A | 9/1973 | Jean Bellot et al. |
| 4,615,658 | A | 10/1986 | Kagohara et al. |
| 4,853,185 | A | 8/1989 | Rothman et al. |
| 4,861,547 | A | 8/1989 | Culling |
| 4,981,647 | A | 1/1991 | Rothman et al. |
| 5,077,006 | A | 12/1991 | Culling |
| 6,485,679 | B1 | 11/2002 | Sundstrom et al. |
| 6,685,881 | B2 | 2/2004 | Hamano et al. |
| 2003/0188808 | A1 | 10/2003 | Ueta et al. |

FOREIGN PATENT DOCUMENTS

| | | |
|---|---|---|
| JP | 354096418 | 7/1979 |

*Primary Examiner* — Deborah Yee
(74) *Attorney, Agent, or Firm* — Edna I. Gergel; Joseph A. Marasco

(57) ABSTRACT

A cast, austenitic steel composed essentially of, expressed in weight percent of the total composition, about 0.4 to about 0.7 C, about 20 to about 30 Cr, about 20 to about 30 Ni, about 0.5 to about 1 Mn, about 0.6 to about 2 Si, about 0.05 to about 1 Nb, about 0.05 to about 1 W, about 0.05 to about 1.0 Mo, balance Fe, the steel being essentially free of Ti and Co, the steel characterized by at least one microstructural component selected from the group consisting of MC, $M_{23}C_6$, and M(C, N).

9 Claims, 4 Drawing Sheets

CAST, HEAT-RESISTANT AUSTENITIC STAINLESS STEELS HAVING REDUCED ALLOYING ELEMENT CONTENT

This application is a continuation of U.S. application Ser. No. 11/038,923 filed on Jan. 19, 2005, now U.S. Pat. No. 7,749,432. The specification of U.S. application Ser. No. 11/038,923 is hereby incorporated by reference in its entirety.

The United States Government has rights in this invention pursuant to contract no. DE-AC05-00OR22725 between the United States Department of Energy and UT-Battelle, LLC.

FIELD OF THE INVENTION

The present invention relates to cast austenitic stainless steels that are resistant to creep at high temperatures, and more particularly to cast austenitic stainless steels that include about 20 to about 30 Cr, about 20 to about 30 Ni and are resistant to creep at temperatures above 1200° C.

BACKGROUND OF THE INVENTION

There is a significant and continued need for low-cost austenitic stainless steel alloys that can be used in the as-cast condition at high temperatures up to 1200° C. Currently available conventional cast steels generally contain significant amounts Ni, Co, W and/or Mo. Moreover, conventional Fe—Cr—Ni cast steels are available with additions of various alloying elements for high temperature use. However, creep properties Of such steels at 1200° C. and above can vary widely within the composition ranges thereof.

There is a need for low-cost, heat resistant austenitic stainless steels for operation at temperatures of 1200° C. and higher. For these alloys, a significant property of interest is their creep-resistance, with oxidation resistance being the second most important property.

OBJECTS OF THE INVENTION

Accordingly, objects of the present invention include provision of a cast, austenitic steel characterized by a creep life of at least 480 hours at a stress of up to 500 psi and at a temperature of at least 1200° C. Further and other objects of the present invention will become apparent from the description contained herein.

SUMMARY OF THE INVENTION

In accordance with an aspect of the present invention, the foregoing and other objects are achieved by cast, austenitic steel composed essentially of, expressed in weight percent of the total composition, about 0.4 to about 0.7 C, about 20 to about 30 Cr, about 20 to about 30 Ni, about 0.5 to about 1 Mn, about 0.6 to about 2 Si, about 0.05 to about 1 Nb, about 0.05 to about 1 W, about 0.05 to about 1.0 Mo, balance Fe, the steel being essentially free of Ti and Co, the steel characterized by at least one microstructural component selected from the group consisting of MC, $M_{23}C_6$, and M(C, N).

For a better understanding of the present invention, together with other and further objects, advantages and capabilities thereof, reference is made to the following disclosure and appended claims in connection with the above-described drawings.

DETAILED DESCRIPTION OF THE INVENTION

The cast steels described herein in accordance with invention were specifically designed to minimize the content of expensive elements such as Ni and Co, for example, while retaining an austenite matrix and other comparable properties. Microstructure is a unique and important characteristic of the described cast steels and forms the basis for their high temperature strength. The microstructure was designed to comprise a stable austenite matrix phase that is resistant to the formation of undesirable intermetallic precipitate phases, such as sigma phase, Laves, or G-silicide, for example, over the temperature range of interest. In accordance with the present invention, optimum combinations and dispersions of MC and $M_{23}C_6$ carbides are promoted through the addition of alloying elements.

The alloys provided by the present invention comprise Fe—Ni—Cr alloys with the composition of the alloys in the typical range shown in Table 1; ranges are expressed in wt. %.

TABLE 1

| Element | Operable Range | Preferable Range | Most Preferable |
|---|---|---|---|
| C | 0.4 to 0.7 | 0.5 to 0.65 | 0.6 |
| Cr | 20 to 30 | 22 to 28 | 25 |
| Ni | 20 to 30 | 22 to 28 | 25 |
| Mn | 0.5 to 1 | 0.6 to 0.9 | 0.7 |
| Si | 0.6 to 2 | 0.9 to 1.7 | 1.45 |
| Nb | 0.05 to 1 | 0.1 to 0.3 | 0.3 |
| W | 0.05 to 1 | 0.1 to 0.44 | 0.5 |
| Mo | 0.05 to 1 | 0.1 to 0.3 | 0.2 |
| Fe | Balance | Balance | Balance |

Si is added for ease of casting, carburization resistance, and enhanced oxidation resistance.

Ni content is restricted to the selected range in order to reduce cost of the cast steel. Sufficient nickel content is essential to maintain the austenitic structure.

Cr is essential for oxidation resistance and carbide formation but is a ferrite stabilizer. The selected range provides sufficient corrosion resistance but enables retention of the austenitic structure.

Intentional addition of N is not required to achieve desired properties. However, addition of N does not impair the invention and may even enhance performance in some embodiments of the invention.

Moreover, Ti addition is not necessary for achieving required properties; elimination of Ti also helps in the ability to cast thin walled tubes. Moreover, Co is eliminated, thus significantly reducing the cost of the alloy.

Figure 1:
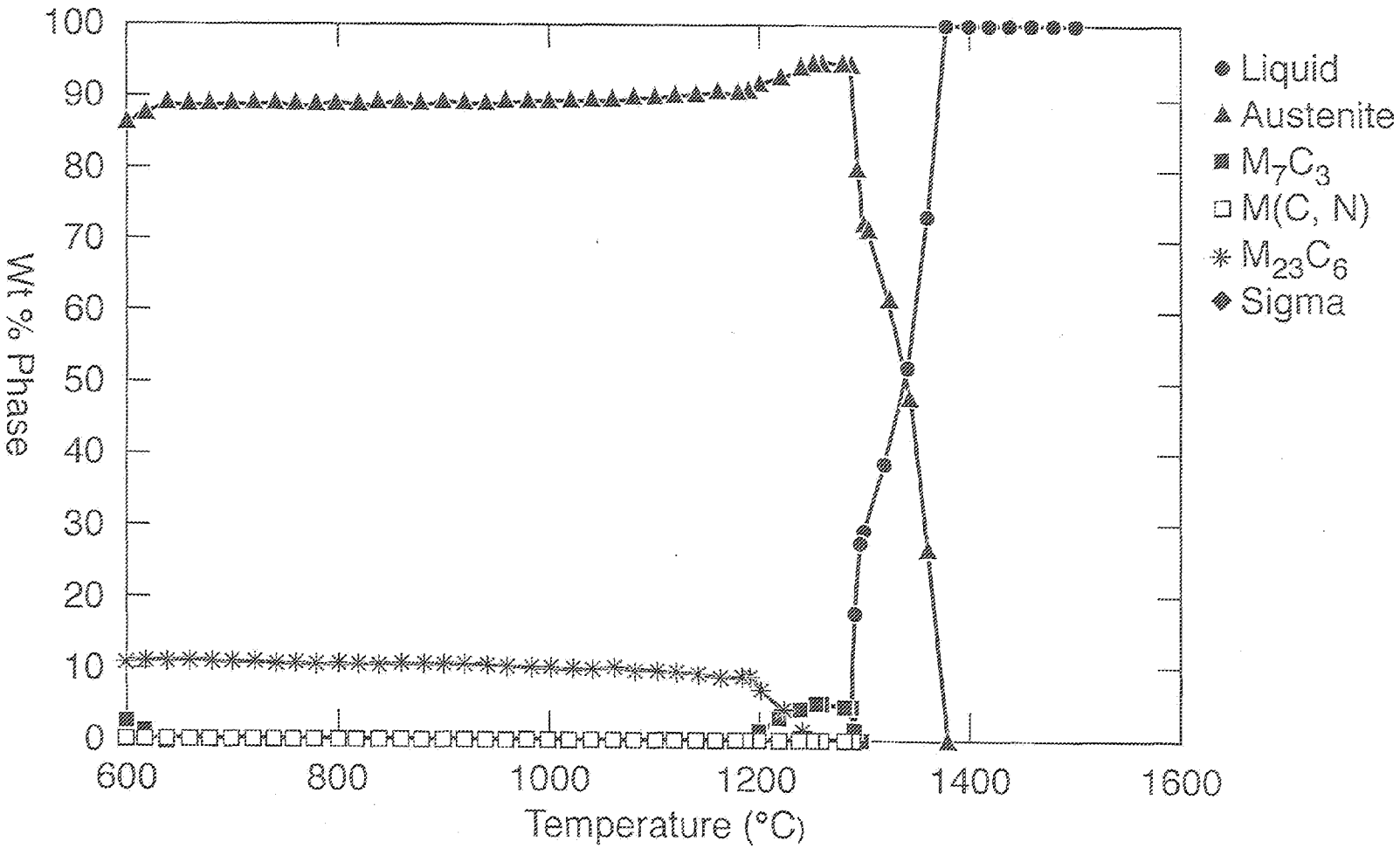
FIG. 1 is a graph showing Equilibrium thermodynamic calculations of phases present at various temperatures in a cast steel in accordance with an embodiment of the present invention.
Figure 2:
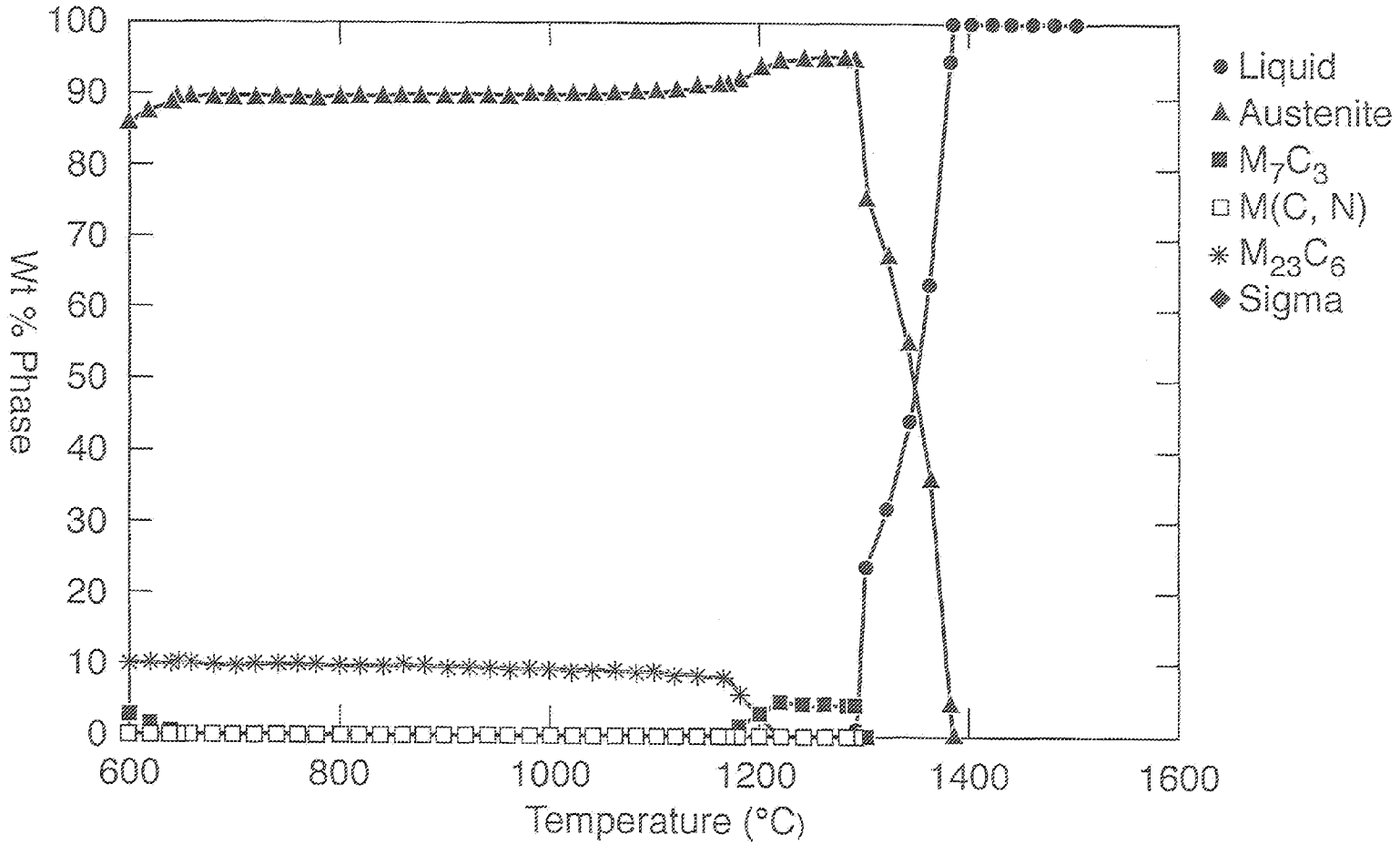
FIG. 2 is a graph showing Equilibrium thermodynamic calculations of phases present at various temperatures in a cast steel in accordance with another embodiment of the present invention
Figure 3:
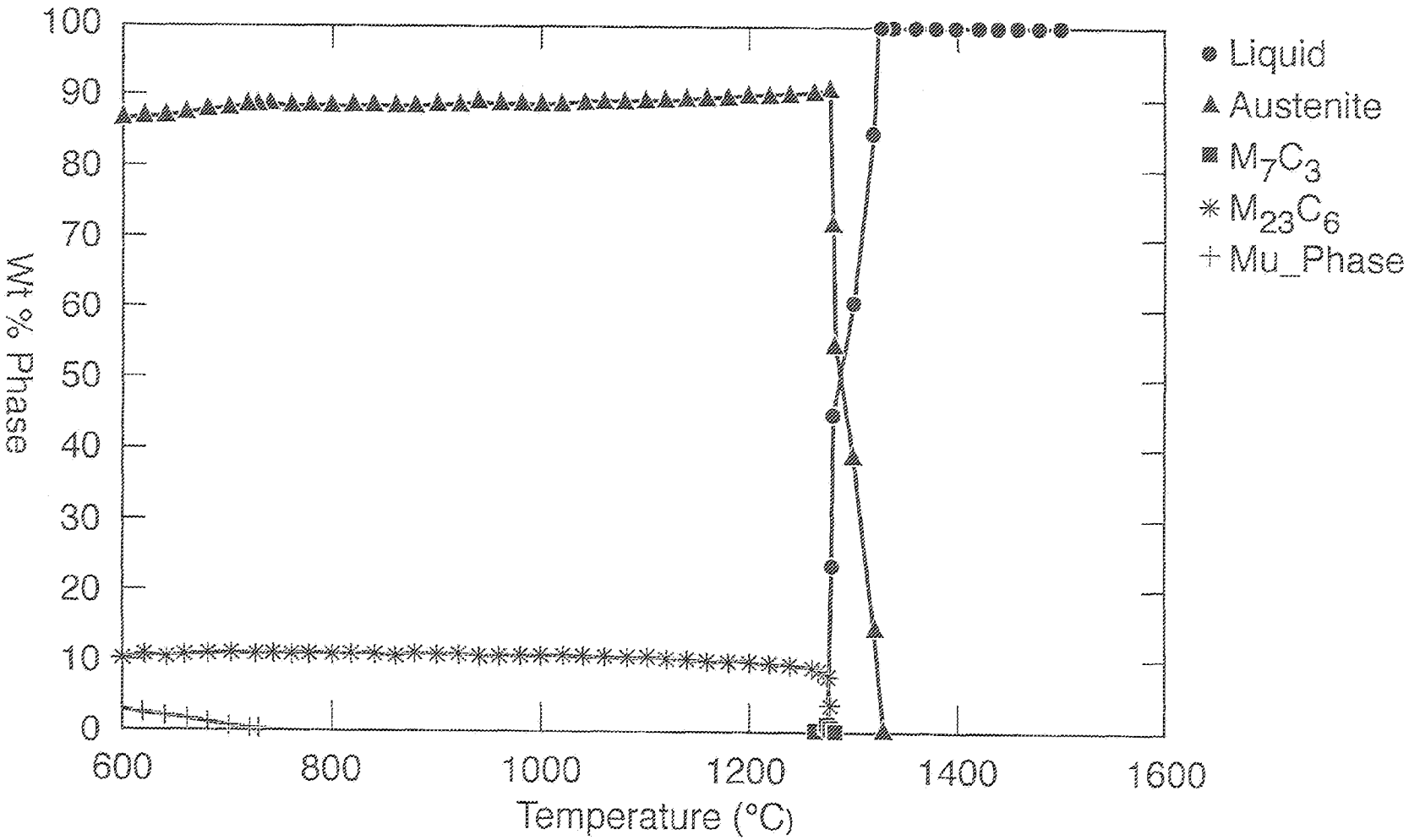
FIG. 3 is a graph showing Equilibrium thermodynamic calculations of phases present at various temperatures in a cast steel in accordance with another embodiment of the present invention
Figure 4:
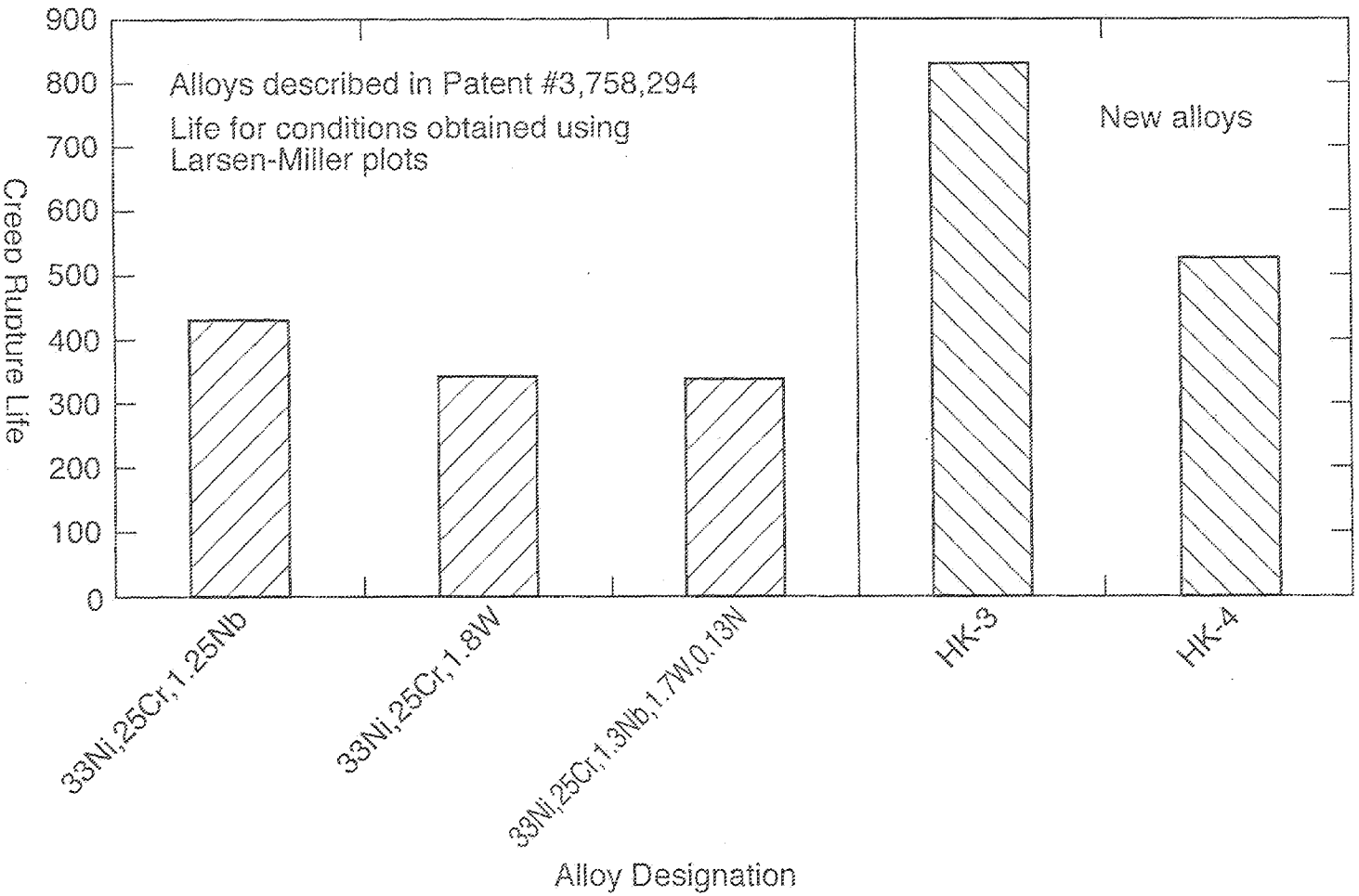
FIG. 4 is a graph showing that alloys in accordance with another embodiment of the present invention show improved creep life at 1204° C., 500 psi.

FIG. 1 shows a summary report of the phases present as a function of temperature for an alloy comprising 0.61% C, 24.5% Cr, 25.2% Ni, 0.7% Mn, 1.45% Si, 0.17% Mo, 0.46% W, balance Fe while FIG. 2 shows the results of another alloy comprising 0.57% C, 24.8% Cr, 25.4% Ni, 0.7% Mn, 1.42% Si, 0.11% Mo, 0.09% Nb, 0.10% W, balance Fe.

Phases present at temperatures in the range 1000-1200° C. include austenite, $M_7C_3$, M(C, N), and $M_{23}C_6$. In particular, differences are observable in the calculated values of the various types of carbides present at 1200° C. Table 2 shows two examples of preferred embodiments of the present invention. The alloys were centrifugally cast into tubes. Creep testing was performed in air at 1204° C. (2200° F.) and 500 psi. For comparison, the properties obtained from a conventional steel known as Supertherm (trademark of Duraloy Technologies, Inc., Scottdale, Pa.) are also shown in the tables. Compositions are expressed in wt. % of the total composition.

Clearly, the alloys of the present invention show much improved creep and oxidation properties at about 1200° C. Table 3 compares the calculated equilibrium wt. % of the $M_7C_3$, $M_{23}C_6$, and M(C, N) in these alloys at about 1200° C. The carbides/carbonitrides are the strengthening phases in these alloys. The increased wt. % carbides in HK-3 correlate well with improved creep properties. Table 4 shows the highest temperatures of stabilities of the phases in the three alloys. It can be seen that the best properties are obtained when both $M_{23}C_6$ and MC are present in the microstructure and in certain amounts.

Compositions in accordance with the present invention can have calculated wt. % $M_{23}C_6$ of at least 2 and no more than 9, preferably least 3 and no more than 8.5, more preferably least 4 and no more than 8.

Moreover, compositions in accordance with the present invention can have total wt. % carbides of at least 6 and no more than 9, preferably least 6.5 and no more than 8.8, more preferably least 7 and no more than 8.5.

Moreover, in a composition in accordance with the present invention, sigma (σ) phase formation should occur at the lowest possible temperature, for example, a temperature no higher than 680° C., preferably no higher than 670° C., more preferably no higher than 660° C.

Table 5 shows compositions and characteristics of further embodiments of the present invention. It can be seen that variations in the compositions result in various combinations and trade-offs in microstructural components.

While there has been shown and described what are at present considered the preferred embodiments of the invention, it will be obvious to those skilled in the art that various changes and modifications can be prepared therein without departing from the scope of the inventions defined by the appended claims.

TABLE 2

| Alloy | C | Cr | Ni | Mn | Si | Mo | W | Nb | Fe | Co | Creep Life (Hrs) 1204° C. (2200 F.), 500 psi |
|---|---|---|---|---|---|---|---|---|---|---|---|
| HK-3* | 0.61 | 24.5 | 25.2 | 0.7 | 1.45 | 0.17 | 0.46 | 0.28 | 46.63 | — | 831 |
| HK-4* | 0.57 | 24.8 | 25.4 | 0.7 | 1.42 | 0.11 | 0.10 | 0.09 | 46.81 | — | 526 |
| Supertherm | 0.526 | 25.9 | 34.3 | 0.7 | 1.5 | 0.02 | 4-6 | — | Balance | 14-16 | 487 |

TABLE 3

| Alloy | C | Cr | Ni | Mn | Si | Mo | W | Nb | Co | Fe | Calc. Wt. % $M_7C_3$ | Calc. wt. % $M_{23}C_6$ | Calc. Wt. % MC | Total Wt. % Carbides | Creep Life @ 1204° C. |
|---|---|---|---|---|---|---|---|---|---|---|---|---|---|---|---|
| HK-3 | 0.61 | 24.5 | 25.2 | 0.7 | 1.45 | 0.17 | 0.46 | 0.28 | 0 | 46.63 | 1.01 | 6.91 | 0.26 | 8.18 | 831 |
| HK-4 | 0.57 | 24.8 | 25.4 | 0.7 | 1.42 | 0.11 | 0.10 | 0.09 | 0 | 46.81 | 3.35 | 2.65 | 0.04 | 6.04 | 526 |
| Supertherm | 0.53 | 25.8 | 34.3 | 0.7 | 1.5 | 0.02 | 4.78 | 0.01 | 15.1 | 17.26 | 0 | 9.57 | 0 | 9.57 | 487 |

TABLE 4

| Alloy | Maximum Temperature of Stability of $M_{23}C_6$ (° C.) | Maximum Temperature of stability of Sigma Phase or Mu Phase (° C.) | Maximum Phase Fraction of $M_{23}C_6$ Between 600° C. and 1500° C. | Maximum Phase Fraction of MC Between 600° C. and 1500° C. |
|---|---|---|---|---|
| HK-3 | 1250.6 | 639.4 | 10.7 | 0.32 |
| HK-4 | 1215.7 | 647.9 | 10.14 | 0.12 |
| Supertherm | 1280° C. (Forms from Liquid) | 728.5° C. (Mu Phase) | 10.3 | 0 |

TABLE 5

| Alloy | C | Cr | Ni | Mn | Si | Mo | Nb | W | Fe | Calc. Wt. % $M_7C_3$ | Calc. wt. % $M_{23}C_6$ | Calc. Wt. % MC | Total Wt. % Carbides | Max. Temp. of σ Phase Formation |
|---|---|---|---|---|---|---|---|---|---|---|---|---|---|---|
| 1 | 0.6 | 25 | 25 | 0.69 | 1.5 | 0.1 | 0.1 | 0.1 | Balance | 3.87 | 2.36 | 0.05 | 6.28 | 648.9 |
| 2 | 0.6 | 25 | 25 | 0.69 | 1.5 | 0.2 | 0.1 | 0.1 | Balance | 2.4 | 4.75 | 0.05 | 7.2 | 651.3 |
| 3 | 0.6 | 25 | 25 | 0.69 | 1.5 | 0.3 | 0.1 | 0.1 | Balance | 1.17 | 6.84 | 0.05 | 8.06 | 653.7 |
| 4 | 0.6 | 25 | 25 | 0.69 | 1.5 | 0.1 | 0.2 | 0.1 | Balance | 3.4 | 2.91 | 0.17 | 6.48 | 656.7 |
| 5 | 0.6 | 25 | 25 | 0.69 | 1.5 | 0.2 | 0.2 | 0.1 | Balance | 1.95 | 5.28 | 0.17 | 7.4 | 659.1 |
| 6 | 0.6 | 25 | 25 | 0.69 | 1.5 | 0.3 | 0.2 | 0.1 | Balance | 0.68 | 7.36 | 0.17 | 8.21 | 661.5 |
| 7 | 0.6 | 25 | 25 | 0.69 | 1.5 | 0.1 | 0.3 | 0.1 | Balance | 2.94 | 3.47 | 0.28 | 6.69 | 664.1 |

TABLE 5-continued

| Alloy | C | Cr | Ni | Mn | Si | Mo | Nb | W | Fe | Calc. Wt. % $M_7C_3$ | Calc. wt. % $M_{23}C_6$ | Calc. Wt. % MC | Total Wt. % Carbides | Max. Temp. of σ Phase Formation |
|---|---|---|---|---|---|---|---|---|---|---|---|---|---|---|
| 8 | 0.6 | 25 | 25 | 0.69 | 1.5 | 0.2 | 0.3 | 0.1 | Balance | 1.5 | 5.82 | 0.28 | 7.6 | 666.5 |
| 9 | 0.6 | 25 | 25 | 0.69 | 1.5 | 0.3 | 0.3 | 0.1 | Balance | 0.23 | 7.88 | 0.28 | 8.39 | 669 |
| 10 | 0.6 | 25 | 25 | 0.69 | 1.5 | 0.1 | 0.1 | 0.2 | Balance | 2.89 | 3.98 | 0.05 | 6.92 | 651.5 |
| 11 | 0.6 | 25 | 25 | 0.69 | 1.5 | 0.2 | 0.1 | 0.2 | Balance | 1.58 | 6.12 | 0.05 | 7.75 | 653.9 |
| 12 | 0.6 | 25 | 25 | 0.69 | 1.5 | 0.3 | 0.1 | 0.2 | Balance | 0.39 | 8.06 | 0.05 | 8.5 | 656.4 |
| 13 | 0.6 | 25 | 25 | 0.69 | 1.5 | 0.1 | 0.2 | 0.2 | Balance | 2.44 | 4.51 | 0.17 | 7.12 | 659.3 |
| 14 | 0.6 | 25 | 25 | 0.69 | 1.5 | 0.2 | 0.2 | 0.2 | Balance | 1.14 | 6.64 | 0.17 | 7.95 | 661.7 |
| 15 | 0.6 | 25 | 25 | 0.69 | 1.5 | 0.3 | 0.2 | 0.2 | Balance | 0 | 8.5 | 0.17 | 8.67 | 664.2 |
| 16 | 0.6 | 25 | 25 | 0.69 | 1.5 | 0.1 | 0.3 | 0.2 | Balance | 1.99 | 5.05 | 0.28 | 7.32 | 666.7 |
| 17 | 0.6 | 25 | 25 | 0.69 | 1.5 | 0.2 | 0.3 | 0.2 | Balance | 0.69 | 7.17 | 0.28 | 8.14 | 669.2 |
| 18 | 0.6 | 25 | 25 | 0.69 | 1.5 | 0.3 | 0.3 | 0.2 | Balance | 0 | 8.31 | 0.28 | 8.59 | 671.8 |
| 19 | 0.6 | 25 | 25 | 0.69 | 1.5 | 0.1 | 0.1 | 0.3 | Balance | 2.04 | 5.39 | 0.05 | 7.48 | 654 |
| 20 | 0.6 | 25 | 25 | 0.69 | 1.5 | 0.2 | 0.1 | 0.3 | Balance | 0.83 | 7.38 | 0.05 | 8.26 | 656.5 |
| 21 | 0.6 | 25 | 25 | 0.69 | 1.5 | 0.3 | 0.1 | 0.3 | Balance | 0 | 8.76 | 0.05 | 8.81 | 659.1 |
| 22 | 0.6 | 25 | 25 | 0.69 | 1.5 | 0.1 | 0.2 | 0.3 | Balance | 1.6 | 5.92 | 0.17 | 7.69 | 661.9 |
| 23 | 0.6 | 25 | 25 | 0.69 | 1.5 | 0.2 | 0.2 | 0.3 | Balance | 0.39 | 7.89 | 0.17 | 8.45 | 664.4 |
| 24 | 0.6 | 25 | 25 | 0.69 | 1.5 | 0.3 | 0.2 | 0.3 | Balance | 0 | 8.57 | 0.17 | 8.74 | 667 |
| 25 | 0.6 | 25 | 25 | 0.69 | 1.5 | 0.1 | 0.3 | 0.3 | Balance | 1.15 | 6.45 | 0.28 | 7.88 | 669.4 |
| 26 | 0.6 | 25 | 25 | 0.69 | 1.5 | 0.2 | 0.3 | 0.3 | Balance | 0 | 8.33 | 0.28 | 8.61 | 671.9 |
| 27 | 0.6 | 25 | 25 | 0.69 | 1.5 | 0.3 | 0.3 | 0.3 | Balance | 0 | 8.38 | 0.28 | 8.66 | 674.5 |
| 28 | 0.6 | 25 | 25 | 0.69 | 1.5 | 0.1 | 0.1 | 0.4 | Balance | 1.27 | 6.7 | 0.05 | 8.02 | 656.7 |
| 29 | 0.6 | 25 | 25 | 0.69 | 1.5 | 0.2 | 0.1 | 0.4 | Balance | 0.13 | 8.56 | 0.05 | 8.74 | 659.2 |
| 30 | 0.6 | 25 | 25 | 0.69 | 1.5 | 0.3 | 0.1 | 0.4 | Balance | 0 | 8.82 | 0.05 | 8.87 | 661.8 |
| 31 | 0.6 | 25 | 25 | 0.69 | 1.5 | 0.1 | 0.2 | 0.4 | Balance | 0.83 | 7.21 | 0.17 | 8.21 | 664.6 |
| 32 | 0.6 | 25 | 25 | 0.69 | 1.5 | 0.2 | 0.2 | 0.4 | Balance | 0 | 8.58 | 0.17 | 8.75 | 667.1 |
| 33 | 0.6 | 25 | 25 | 0.69 | 1.5 | 0.3 | 0.2 | 0.4 | Balance | 0 | 8.63 | 0.17 | 8.8 | 669.7 |
| 34 | 0.6 | 25 | 25 | 0.69 | 1.5 | 0.1 | 0.3 | 0.4 | Balance | 0.39 | 7.73 | 0.28 | 8.4 | 672.1 |
| 35 | 0.6 | 25 | 25 | 0.69 | 1.5 | 0.2 | 0.3 | 0.4 | Balance | 0 | 8.39 | 0.28 | 8.67 | 674.7 |
| 36 | 0.6 | 25 | 25 | 0.69 | 1.5 | 0.3 | 0.3 | 0.4 | Balance | 0 | 8.44 | 0.28 | 8.72 | 677.3 |

What is claimed is:

1. A cast, austenitic steel consisting essentially of, expressed in weight percent of the total composition, about 0.4 to about 0.7 C, 22 to 28 Cr, about 20 to about 30 Ni, about 0.5 to about 1 Mn, about 0.6 to about 2 Si, about 0.05 to about 1 Nb, about 0.05 to about 1 W, about 0.05 to about 1.0 Mo, balance Fe, said steel being essentially free of Ti and Co, said steel characterized by at least one microstructural component selected from the group consisting of MC, $M_{23}C_6$, and M(C, N), wherein total carbides are in the amount of a total weight percent of at least 6 and no more than 9 at a temperature of about 1200° C., and wherein sigma phase formation occurs at a temperature no higher than 680° C.

2. A cast, austenitic steel in accordance with claim 1 further characterized by a creep life of at least 480 hours at a stress of up to 500 psi and at a temperature of at least 1200° C.

3. A cast, austenitic steel in accordance with claim 1 further characterized by at least one microstructural component comprising $M_{23}C_6$ in the amount of a calculated weight percent of at least 2 and no more than 9.

4. A cast, austenitic steel in accordance with claim 3 wherein said $M_{23}C_6$ is in the amount of a calculated weight percent of at least 3 and no more than 8.5.

5. A cast, austenitic steel in accordance with claim 4 wherein said $M_{23}C_6$ is in the amount of a calculated weight percent of at least 4 and no more than 8.

6. A cast, austenitic steel in accordance with claim 1 wherein said total carbides are in the amount of a calculated weight percent of at least 6.5 and no more than 8.8.

7. A cast, austenitic steel in accordance with claim 6 wherein said total carbides are in the amount of a calculated weight percent of at least 7 and no more than 8.5.

8. A cast, austenitic steel in accordance with claim 1 wherein sigma phase formation occurs at a temperature no higher than 670° C.

9. A cast, austenitic steel in accordance with claim 8 wherein sigma phase formation occurs at a temperature no higher than 660° C.

* * * * *